US011835232B2

(12) United States Patent
Van Der Woude et al.

(10) Patent No.: US 11,835,232 B2
(45) Date of Patent: Dec. 5, 2023

(54) INDUSTRIAL CHIMNEY FOR WET STACK OPERATION PROVIDED WITH AN INTERNAL LINING SYSTEM

(71) Applicant: HADEK PROTECTIVE SYSTEMS B.V., Rotterdam (NL)

(72) Inventors: Bastiaan Van Der Woude, Rotterdam (NL); Albert De Kreij, Rotterdam (NL)

(73) Assignee: HADEK PROTECTIVE SYSTEMS B.V., Rotterdam (NL)

( * ) Notice: Subject to any disclaimer, the term of this patent is extended or adjusted under 35 U.S.C. 154(b) by 390 days.

(21) Appl. No.: 16/647,842

(22) PCT Filed: Aug. 6, 2019

(86) PCT No.: PCT/NL2019/050513
§ 371 (c)(1),
(2) Date: Mar. 16, 2020

(87) PCT Pub. No.: WO2020/032791
PCT Pub. Date: Feb. 13, 2020

(65) Prior Publication Data

US 2021/0381690 A1 Dec. 9, 2021

(30) Foreign Application Priority Data

Aug. 8, 2018 (NL) ..... 2021439

(51) Int. Cl.
*F23J 13/02* (2006.01)
*E04G 23/00* (2006.01)
*F23M 5/02* (2006.01)

(52) U.S. Cl.
CPC ..... *F23J 13/02* (2013.01); *E04G 23/008* (2013.01); *F23M 5/02* (2013.01); *F23J 2213/10* (2013.01)

(58) Field of Classification Search
CPC ..... F23J 13/02; F23J 2213/10; E04G 23/008
USPC ..... 454/44
See application file for complete search history.

(56) References Cited

U.S. PATENT DOCUMENTS

2010/0206456 A1 8/2010 Vandiver et al.

FOREIGN PATENT DOCUMENTS

| | | | |
|---|---|---|---|
| CN | 2844699 | Y | 12/2006 |
| DE | 3511212 | A1 | 10/1986 |
| FR | 781423 | A | 5/1935 |
| GB | 373911 | A | 6/1932 |
| JP | S55152314 | A | 11/1980 |
| KR | 1478006 | B1 * | 1/2015 |

OTHER PUBLICATIONS

International Search Report dated Oct. 23, 2019, corresponding to Application No. PCT/NL2019/050513.
Netherlands Search Report dated Mar. 25, 2019, corresponding to Application No. 2021439.

* cited by examiner

*Primary Examiner* — Allen R. B. Schult
(74) *Attorney, Agent, or Firm* — Patterson + Sheridan, LLP

(57) ABSTRACT

An industrial chimney for wet stack operation is provided with an internal lining system attached to the inner surface of the chimney. The internal lining system comprises construction elements, that are arranged in a pattern, such that the joints between the construction elements in the pattern at the flue gas side of the internal lining system are inclined at an angle α of at least 5 degrees from horizontal.

11 Claims, 3 Drawing Sheets

INDUSTRIAL CHIMNEY FOR WET STACK OPERATION PROVIDED WITH AN INTERNAL LINING SYSTEM

TECHNICAL FIELD

The present invention relates to an industrial chimney, in particular designed for wet stack operation comprising an internal lining system.

BACKGROUND ART

Nowadays many coal-fired utility power plants employ flue gas technologies. In most wet stack operations flue gas enters the stack directly from the flue gas plant. A "wet stack" is a chimney, stack, or flue that exhausts water saturated flue gas downstream from a wet-scrubbing process, such as a wet flue gas desulfurization (WFGD) system. Most recently designed and constructed WFGD systems have installed wet stacks. Although the technology is relatively mature, there are a number of technical issues that utilities must address to achieve a successful installation. The Revised Wet Stack Design Guide, final report 1026742, Copyright © 2012 Electric Power Research Institute, Inc., (hereafter the EPRI Guide) is still the guide on wet stack design, whether the installation is new or retrofit.

From the EPRI Guide it is known that the design of ducts and stacks for wet operation must address several issues that were not present in unscrubbed or reheated gas stack designs. One of the important issues to consider in the design of a wet stack system is the gas velocity in the chimney. A relevant issue is whether the gas velocity will result in droplet re-entrainment from the internal lining applied to the inner surface of a chimney. The liquid on the lining surface is produced by deposition and condensation. Its flow in the form of droplets, film or rivulets is governed by gravitational, surface-tension, and gas-shear forces. As the droplets accumulate, they are pulled downward by gravity, whereas the gas drags the liquid in the same direction as the flow direction of the gas. When the force from the gas reaches or exceeds the forces of gravity and surface tension, the liquid is sheared from the ductwork or liner walls. Liquid then re-enters or is re-entrained back into the gas stream and is carried out of the stack. When this occurs, the gas velocity is referred to as the critical re-entrainment velocity. Re-entrainment is the most frequent source of stack liquid discharge (SLD), also known as rainout or acid-mist fallout, of liquid droplets in the vicinity of the stack.

It is known from the EPRI Guide that surface discontinuities and protrusions, such as weld seams, fiberglass-reinforced plastic (FRP) joints, and joints of mortar or mastic in internal linings may disrupt gas and liquid flow locally, causing re-entrainment. As a result, liquid re-entrainment will be in the form of large droplets (300-6000 μm), that will be discharged at the top of the stack. Droplets of this size will impact ground-level surfaces in the vicinity of the wet stack installation because they will not be able to evaporate before reaching the ground. This is a significant problem.

The liquid-film flow over the internal lining is a function of the gas-shear and gravitational forces, which are acting in opposite directions to each other. For most internal lining surfaces, in which gas velocities are below 19.8 m/s (65 ft/sec), gravitational forces dominate, and the liquid film will flow downward. At velocities between 21.3 and 27.4 m/s (70 and 90 ft/s), the gravitational and shear forces have approximately the same magnitude, and the forces are balanced. In this range, the liquid film on the internal lining will generally be stagnant on the wall and will not move in either direction. At velocities above 27.4 m/s (90 ft/s), the gas-shear forces dominate, and the liquid film will start to flow vertically toward the stack outlet. This velocity point is called the flow-reversal velocity. It is therefore common to operate at maximum values of the gas velocity below the critical re-entrainment velocity, e.g. 18.5 m/s.

The observations described above apply to the ideal case of a smooth wetting surface. In reality, the surfaces of the internal lining are anything but smooth. Common construction elements for use in an internal lining system include acid bricks (typically ceramic tiles of about 25×25 $cm^2$); alloys (typically high-quality steel sheets of 2 mm welded against a low-grade carbon steel of 8 mm), fibreglass reinforced plastics (FRP; cans made of about 3-5 cm thick plastic, which are about 5 to 7 meters in height) and silicate glass blocks, in particular borosilicate blocks (e.g., Pennguard® blocks made from closed cell foam of borosilicate glass). On alloy lining systems, there are horizontal weld beads; on FRP lining systems, there are joints between adjacent cans; and on brick lining, there are horizontal mortar joints every 2-4 inch (50-100 mm) up the entire height of chimney. Similar horizontal adhesive (mastic) joints may be found in lining systems made with (boro) silicate blocks. These disturbances are referred to as lining-wall discontinuities. From the EPRI Guide it is known that when the liquid film flows over a horizontal discontinuity, there is a potential for the upward-flowing flue gas to get under the liquid, resulting in the formation of droplets. As mentioned above, if the gas velocity is high enough, a portion of these droplets will be re-entrained back into the gas flow and will exit the lining and stack as SLD.

The currently recommended lining-gas velocities for several lining materials are presented in Table 2-1 of the EPRI Guide. The recommended values also provide the plant some margin to account for increases in the flue gas flow rate as a result of changes in fuel source, increases in plant efficiency, and/or future increases in plant output. For borosilicate blocks the recommended stack-liner velocity for wet operation is 18.3 m/s (60 ft/s). This recommendation takes into account the significant increase in the effective surface area afforded by the closed-cell surface structure of the material and the resulting increased surface-tension forces holding the liquid to the material.

It is an object of the present invention to raise the critical re-entrainment velocity of the flue gas in an industrial chimney.

SUMMARY OF THE INVENTION

Accordingly, the invention provides an industrial chimney for wet stack operation provided with an internal lining system attached to the inner surface of the chimney, wherein the internal lining system comprises construction elements, that are arranged in a pattern, wherein the joints between the construction elements in the pattern at the flue gas side of the internal lining system are inclined at an angle $\alpha$ of at least 5 degrees from horizontal.

Principally the internal lining system is composed of a pattern of construction elements, that are arranged such that between adjacent elements at the surface thereof that comes in contact with the flue gas there are no horizontal adhesive joints. Instead thereof these joints between vertically adjacent construction elements are inclined with respect to the horizontal.

Surprisingly it has been found that the absence of such horizontal joints of adhesive at the flue gas contacting surface of the internal lining system favours the liquid flow in downward direction. This allows to increase the gas velocity without the occurrence of liquid re-entrainment in the flue gas in a wet stack operation. Thus the critical re-entrainment velocity in the invention is higher than in a prior art chimney provided with an internal lining system of closed cell borosilicate glass blocks having horizontal joints of adhesive. The invention is also applicable to other prior art construction elements of an internal lining system of an industrial chimney as discussed above, which typically show a horizontal joint, weld or seam, such as acid bricks, alloy plates, plastic cans.

The invention offers an increased safety margin towards SLD at the same recommended gas-liner velocity in a prior art chimney. The increased critical re-entrainment velocity allows a higher volume of the flue gas through a chimney without risking SLD. The invention also enables increasing the capacity of existing chimneys with a given diameter, as well as higher capacities at small diameter stacks.

A further aspect of the invention is directed to a method for refurbishing an existing chimney with a fresh internal lining system as outlined above for the purpose of increasing the critical re-entrainment velocity.

DESCRIPTION OF EMBODIMENTS

Figure 1:
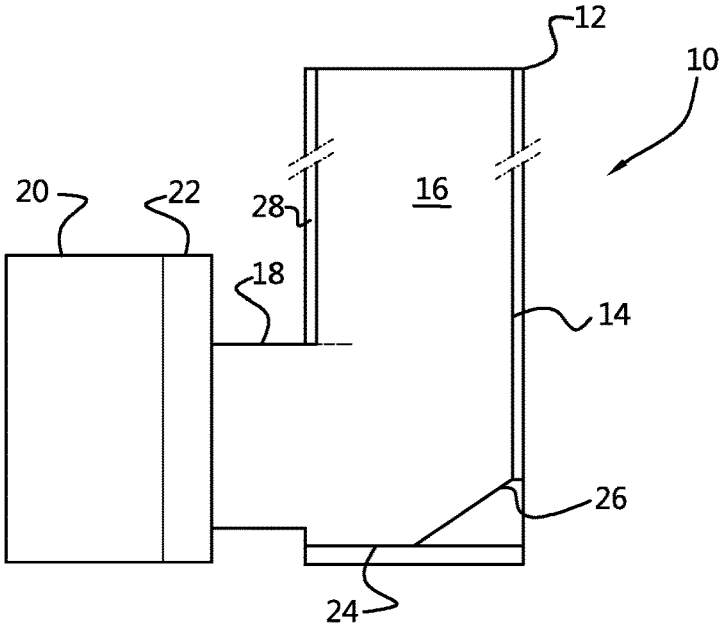
FIG. 1 shows a schematic representation of an embodiment of an industrial chimney according to the invention.

Various internal lining systems are known from the EPRI Guide. Although coatings may also be used as internal lining system, they are excluded from the present invention. The present invention therefore covers internal lining systems composed of construction elements with adhesive joints that are present at the flue gas side and result in surface discontinuities. In the present application, the definition of joints includes seams, welds, junctures and the like between the construction elements.

According to the invention the construction elements are arranged in a pattern, wherein the joints between construction elements in the pattern at the flue gas side of the internal lining system are inclined at an angle $\alpha$ of at least 5 degrees from horizontal. Where in the present invention reference is made to the angle $\alpha$, this is the angle made by the joints, present at the inside of the internal lining system, with respect to horizontal. Angle $\alpha$ is the smallest angle versus horizontal, with other joints being more inclined.

It will be understood that at the edges of the pattern, e.g. at the lower edge near the horizontal bottom of the chimney and at the upper edge at the horizontal top of the chimney, being a cylindrical shell that optionally tapers towards the tip, in order to completely clad the inner chimney wall with the protective internal lining system a horizontal edge joint may be present. The construction elements typically rest on a horizontal element, such as a floor or plinth. The space between the bottom and the lower construction elements of the patterned internal lining system may be filled with terminal construction elements specially designed for this purpose. Such terminal construction elements may also be present at the top of the chimney or at a transition from the pattern of construction elements according to the invention to a regular pattern having horizontal joints, which may be present in an upper area of the chimney. If the spaces are small, they may also be filled with adhesive.

The patterned internal lining system is arranged at the locations in the chimney where the risk of re-entrainment is the highest, typically the lower region of the chimney extending from the floor upwards. Preferably the patterned internal lining system according to the invention extends over the full height of the chimney.

The use of an internal lining internal lining system that is inclined at an angle $\alpha$ of at least 5, more preferably at least 10, more preferably between 20 and 45 degrees from horizontal is very counter-intuitive. First it entails more time and effort to introduce the construction elements of the internal lining internal lining system "at an angle" relative to horizontal. Second, in certain embodiments this may result in an increase of adhesive needed to install the construction elements with a (very slight) decrease of the cross section of the internal lining system. For instance, industrial chimneys for wet stack operation are typically between 50 and 400 meters high, such as from 100-175 metres high. Although the general shape of the cross section (flow through area) of the duct, such as square, rectangular, elliptical is not critical, typically the flow through area will be circular with diameters ranging from 3 meter to 15 metres. When rectangular-shaped construction elements are applied against the inner wall at an angle versus horizontal, the space between the construction element and the wall may increase. For instance, when use is made of borosilicate blocks as construction element attached to the inner wall at an angle versus horizontal, more adhesive to fill up said empty space is needed. In addition, although the effect is very small, when rectangular-shaped construction elements are used the cross section of the duct decreases. Note in this regard that modified construction elements pursuant to the present invention, e.g., parallelogram-shaped, do not suffer from this disadvantage. Moreover, they may be easier to install. These constructions elements are therefore highly attractive.

The invention has proven to reduce the effect of liner-wall discontinuities, as horizontal joints have disappeared. Holdup over horizontal discontinuities is less problematic as liquid may flow along the inclined joints. As a result, the recommended gas-liner velocity may be increased. For instance, the maximum recommended liner velocity for borosilicate block is increased from 18.3 m/s to 19.8 m/s or more. Similar improvements may be found for acid brick, alloy, and fiberglass reinforced plastic, provided the joints are inclined at an angle $\alpha$ of at least 5 degrees versus horizontal.

In an embodiment the construction elements of the present invention advantageously have a parallel front and back face that are rectangular shaped. For such rectangular shaped construction elements, this means that all the joints in the patterned internal lining system constructed therefrom will be inclined versus horizontal, but also versus vertical.

In another embodiment the construction elements preferably have a front and back face, preferably parallel, in the form of parallelogram, where in the patterned internal lining system the lower and upper joints are inclined at the angle α versus horizontal, while the side joints are vertically arranged. Thus, the invention also concerns parallelogram-shaped construction elements.

Other embodiments of construction elements comprise elements with quadrangular front and back face, prism-shaped (having a parallel front and back face defined by three edges) or hexagonal-shaped (having a parallel front and back face defined by 6 edges).

The construction elements, rectangular or parallelogram shaped, may be staggered along the line inclined at an angle α relative to horizontal, staggered along the vertical line or line inclined at an angle α relative to vertical, or not staggered at all.

Preferably, the construction elements are silicate blocks, more preferably borosilicate blocks, in particular closed cell foam borosilicate blocks. The rectangular construction elements may have conventional dimensions similar to those of the known Pennguard™ glass blocks, typically ((X×Z×Y) in cm) 15.2×22.9×5.1 (6"×9"×2") or 15.2×22.9×3.8 (6"×9"×1.5") in size. The parallelogram shaped construction elements may have comparable dimensions. The present invention may be applied in new chimneys for wet stack operation, during repair of an internal lining system in existing chimneys for wet stack operation and when chimneys are retrofit with an internal lining system. As indicated herein before, the industrial chimney for wet stack operation of the present invention may be operated at a gas velocity higher than currently recommended without risking SLD. The present invention therefore also covers a process for refurbishing existing wet stack installations with an inclined internal lining system according to the present invention for the purpose of increasing the critical re-entrainment velocity thus allowing operating the chimney at gas velocity then presently recommended for a protective lining system according to the prior art.

Figure 2:
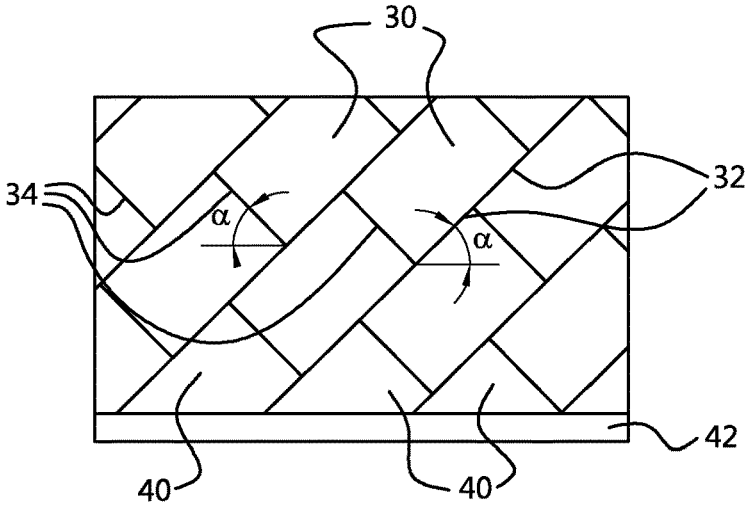
FIG. 2 shows an embodiment of a pattern of an internal lining system according to the invention using rectangular construction elements.
Figure 3:
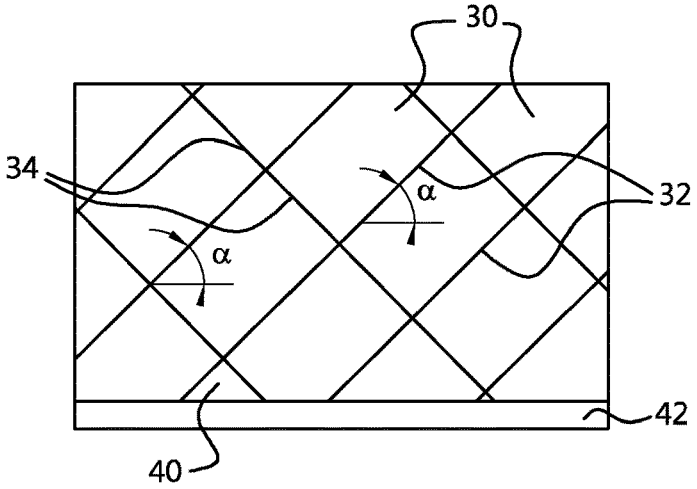
FIG. 3 shows another embodiment of a pattern of an internal lining system according to the invention using rectangular construction elements.
Figure 4:
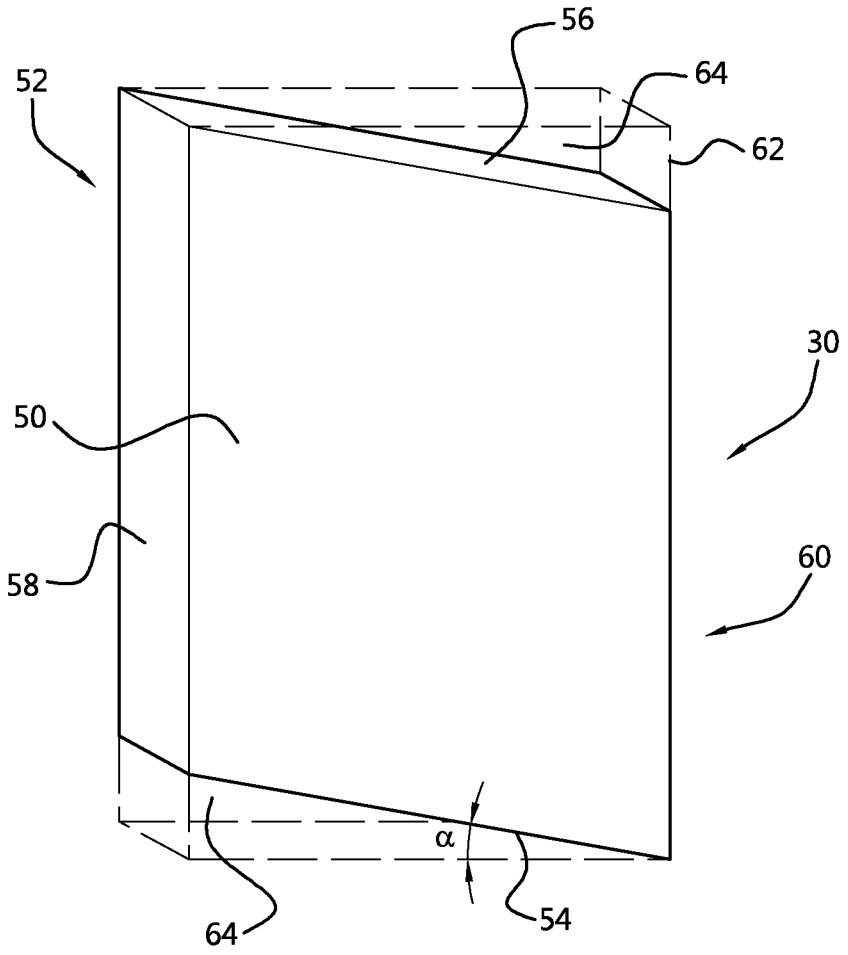
FIG. 4 is a schematic representations of a parallelogram shaped construction element for use in the internal lining system.

The invention is illustrated herein below by the attached drawing, wherein:

FIG. 1 shows a schematic representation of an embodiment of an industrial chimney according to the invention;

FIG. 2 shows an embodiment of a pattern of an internal lining system according to the invention using rectangular construction elements;

FIG. 3 shows another embodiment of a pattern of an internal lining system according to the invention using rectangular construction elements;

FIG. 4 is a schematic representations of a parallelogram shaped construction element for use in the internal lining system.

Figure 5:
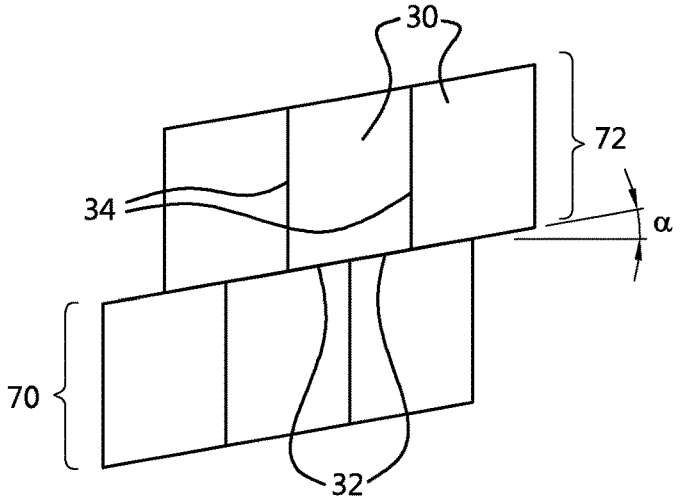
FIG. 5 shows a first embodiment of a pattern of an internal lining system according to the invention using parallelogram shaped construction elements.
Figure 6:
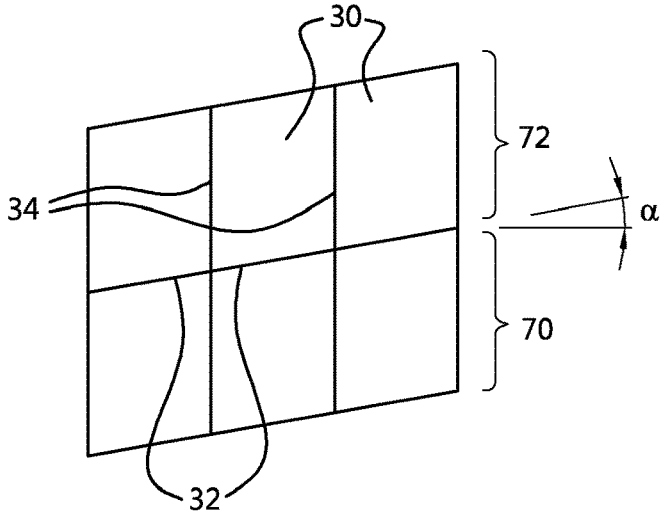
FIG. 6 shows a second embodiment of a pattern of an internal lining system according to the invention using parallelogram shaped construction elements.
Figure 7:
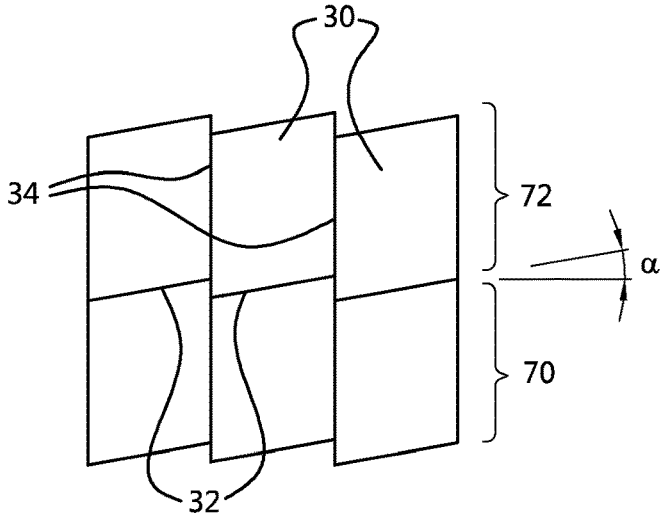
FIG. 7 shows a third embodiment of a pattern of an internal lining system according to the invention using parallelogram shaped construction elements.

FIG. 5 shows a first embodiment of a pattern of an internal lining system according to the invention using parallelogram shaped construction elements;

FIG. 6 shows a second embodiment of a pattern of an internal lining system according to the invention using parallelogram shaped construction elements; and FIG. 7 shows a third embodiment of a pattern of an internal lining system according to the invention using parallelogram shaped construction elements.

In the Figures and the following description the same elements or parts are indicated by the same reference numerals.

In FIG. 1 an embodiment of an industrial chimney 10 for wet stack operation is shown diagrammatically. The upright wet stack 10 comprises a shell 12, provided with an inner lining system 14 according to the invention, e.g. using a common adhesive membrane (not shown). The shell 12 delimits an upstanding duct 16 for flue gas. An inlet 18 for introducing flue gas derived from an industrial plant, such as a (coal-fired) power plant 20 provided with a wet desulphurisation system 22, is positioned at a lower part of the duct 16. Typically a false floor 24 is positioned in the duct 16. A rear deflection plate 26 may be positioned at the inner wall 28 of the shell 12 opposite the inlet 18. The lower row of construction elements of the internal lining system 14 may rest on a horizontal part of the deflection plate 26.

FIG. 2 is a front view of a first embodiment of the patterned internal lining system 14 according to the invention. The internal lining system 14 is constructed from rectangular construction elements 30, such as closed cell borosilicate blocks, e.g. from Pennguard™. The construction elements 30 are arranged such that all adhesive joints 32 and 34 between adjacent elements 30 have an angle α of at least 5 degrees versus the horizontal. In the embodiment shown the angle α is 45 degrees, such that the joints 32 and 34 are perpendicular to one another. The joints 32 directed obliquely to the right are inline with one another, while the joints 34 are staggered. Terminal elements 40 having a horizontal bottom face fill the gaps between a supporting plinth 42 and the construction elements 30 at the lower edge of the patterned internal lining system 14. Alternatively these gaps are filled with adhesive.

FIG. 3 shows another embodiment of a 45 degrees angle patterned internal lining system 14 based on rectangular construction elements 30. In this embodiment the joints 32 are inline with one another, as well as the joints 34.

FIG. 4 shows a preferred embodiment of a parallelogram shaped construction element 30 having a flat front face 50 that in use comes into contact with the flue gas and a back face 52 parallel thereto, as well as a bottom face 54 and a top face 56 that are inclined with an angle α versus horizontal and two vertical lateral faces 58 and 60. The dotted lines in FIG. 4 represent a rectangular starting block 62 from which the construction element 30 can be manufactured, for example by cutting or sawing parts 64 from the block 62. Preferably the construction elements 30 are directly manufactured into the parallelogram shape using suitable moulds.

FIG. 5 is a first embodiment of a pattern of an internal lining system 14 according to the invention using parallelogram shaped construction elements 30. Shown is a first row 70 and second row 72 of parallelogram shaped construction elements 30, that are arranged such that the bottom faces thereof and thus the joint 32 between adjacent elements 30 from the two rows are inclined versus horizontal. The vertical joints 34 between adjacent elements 30 in one row 70, respectively 72 are staggered.

FIG. 6 is a second embodiment of a pattern of an internal lining system 14 according to the invention similar to FIG. 5, except that the vertical joints 34 are aligned in the pattern.

FIG. 7 is a third embodiment of a pattern of an internal lining system 14 according to the invention similar to FIG. 6 having aligned vertical joints 34, except that the bottom faces 54 and thus top faces 56 of adjacent construction elements 30 in a row are staggered. The inclined joints 32 at the bottom faces 54 of adjacent construction elements 30 in one row form a sawtooth line.

Common to all the embodiments of the internal lining systems shown is the absence of horizontal joints between adjacent construction elements thereof.

EXAMPLE

Test panels, representing an internal lining system, were constructed, using a mastic membrane, from conventional Pennguard® borosilicate blocks of 38 mm thick, 152.4 mm wide and 228.6 mm tall, and from building elements according to the invention made from the same material and having similar dimensions. The test panel made of conventional blocks had a commonly staggered pattern, such that the short edges of the blocks were installed horizontally and the long edges were installed vertically. The vertical seams were staggered. The mastic material in the joints was scraped during installation such that the mastic recessed slightly away from the front faces of the blocks. The radial tolerance of construction was less than 3 mm.

A first panel according to the invention was manufactured from parallelogram shaped construction elements (cut along the short edges from conventional Pennguard® borosilicate blocks), wherein the angle $\alpha$ of the oblique joints was 10°, and the vertical joints were staggered as shown in FIG. 5.

A second panel according to the invention was manufactured in a similar way, except that the angle $\alpha$ of the oblique joints was 20°.

A third panel according to the invention was manufactured similar to the first and second panel, except that the inclined joints had a sawtooth pattern as shown in FIG. 7.

A fourth panel according to the invention was manufactured from rectangular construction elements (conventional Pennguard® borosilicate blocks), that were arranged with joints at 45° versus horizontal as shown in FIG. 2, except that the long edge joints were staggered.

The test panels as manufactured were observed to have minimal mastic smearing and minimal radial protrusions.

Each panel oriented vertically was then evaluated at several gas flow conditions ranging from 13.7 m/s (45 ft/s) to 25.9 m/s (85 ft/s) in increments of 1.5 m/s (5 ft/s) in a vertical wind tunnel test facility to determine the performance of the panel with respect to liquid flow, drainage and re-entrainment from the surfaces of the panel.

Liquid was sprayed onto the front faces of the blocks and elements using a high flow spray nozzle to simulate wet stack operation, wherein the internal lining surface will always be wet due to condensation of water vapour from the saturated flue gas. Once the front faces were uniformly wetted a second low flow nozzle was used to inject smaller amounts of water onto specific areas of interest.

At each tested gas flow velocity visual observations were made concerning the:

1) Direction of liquid motion on the surface and over the mastic joints,
2) Observations of the liquid surface appearance as a function of velocity, and
3) Entrainment of liquid from the borosilicate block surfaces or from joints between blocks.

The below Tables summarize the test results.

TABLE 1

Conventional internal lining system

| Gas flow velocity (m/s) | Observations |
|---|---|
| 13.7 | Liquid flows freely down across both the Pennguard ® block faces and the mastic membrane joints. |
| 15.2 | Liquid flows freely down across both the block faces and the mastic membrane joints. Small liquid bars are beginning to form at some of the horizontal mastic joints. |
| 16.8 | Small liquid bars are forming at most of the horizontal mastic joints. Liquid is easily draining across the horizontal mastic joints and down the face of the borosilicate blocks. |
| 18.3 | Larger liquid bars are forming at the horizontal mastic joints. The liquid drainage is very good on the surfaces of the borosilicate blocks. No re-entrainment was observed. |
| 19.8 | There is still good liquid drainage on the surfaces of the borosilicate blocks but the liquid bars are getting larger at the horizontal mastic joints. Minimal re-entrainment was observed. |
| 21.3 | Liquid bars are getting noticeably larger and waves can be seen on their surfaces with some re-entrainment. Liquid is still able to drain across the horizontal mastic joints. More re-entrainment was observed. |
| 22.9 | Liquid bars are getting noticeably larger and waves can be seen on their surfaces. Significant liquid re-entrainment at the liquid bars. The liquid film on the block surface is still flowing down. |
| 24.4 | The panel is entering the flooding regime where the liquid film thickness increases such that the liquid on the gas-liquid interface flows up and the liquid on the block surface flows downward. Significant re-entrainment was observed at numerous locations. |

TABLE 2

10° Inclined parallelogram shaped blocks

| Gas flow velocity (m/s) | Observations |
|---|---|
| 13.7 | Liquid flows freely down across both the block faces and the mastic membrane joints. No observed lateral liquid movement. |
| 15.2 | Liquid flows freely down across both the block faces and the mastic membrane joints. Small liquid bars are beginning to form at some of the horizontal mastic joints. No observed lateral liquid movement. |

TABLE 2-continued

| 10° Inclined parallelogram shaped blocks | |
|---|---|
| Gas flow velocity (m/s) | Observations |
| 16.8 | Small liquid bars are forming at most of the horizontal mastic joints. Liquid is easily draining across the horizontal mastic joints and down the face of the borosilicate blocks. Some minor observed lateral liquid movement in the mastic joints. |
| 18.3 | Larger liquid bars are forming at the horizontal mastic joints. The liquid drainage is very good on the surfaces of the borosilicate blocks. No re-entrainment was observed. |
| 19.8 | There is still good liquid drainage on the surfaces of the borosilicate blocks but the liquid bars are getting larger at the horizontal mastic joints. Sporadic re-entrainment was observed. |
| 21.3 | Liquid bars are getting noticeably larger and waves can be seen on their surfaces with significant re-entrainment. Liquid is struggling to drain across the horizontal mastic joints. |
| 22.9 | Liquid bars are getting noticeably larger and waves can be seen on their surfaces. Significant liquid re-entrainment at the liquid bars. The liquid film on the block surface is still flowing down |
| 24.4 | The panel is entering the flooding regime where the liquid film thickness increases such that the liquid on the gas-liquid interface flows up and the liquid on the block surface flows downward. Significant re-entrainment was observed at many locations. |
| 85 | The panel is in the flooding regime where the liquid film thickness increases such that the liquid on the gas-liquid interface flows up and the liquid on the block surface flows downward. Significant re-entrainment was observed at many locations. |

TABLE 3

| 20° Inclined parallelogram shaped blocks | |
|---|---|
| Gas flow velocity (m/s) | Observations |
| 13.7 | Liquid flows freely down across both the block faces and the mastic membrane joints. |
| 15.2 | Liquid flows freely down across both the block faces and the mastic membrane joints. Some lateral liquid movement was observed at the mastic membrane joints. |
| 16.8 | Small liquid bars are forming at some of the angled mastic joints. Lateral liquid movement was observed at the mastic membrane joints, however; liquid is easily draining across the angled mastic joints and down the face of the borosilicate blocks. |
| 18.3 | Small liquid bars are forming at most of the angled mastic joints. Lateral liquid movement was observed at the mastic membrane joints. The liquid drainage is very good on the surfaces of the borosilicate blocks. No re-entrainment was observed. |
| 19.8 | Larger liquid bars are forming above the angled mastic joints. There is still good liquid drainage on the surfaces of the borosilicate blocks but the liquid drainage is mainly directed laterally along the angled mastic joints. Minimal re-entrainment was observed. |
| 21.3 | Liquid still drains vertically down the block faces, however; once it hits an angled mastic joint it tends to travel laterally until it encounters the sidewall of the wind tunnel. The bars at the sidewall are getting noticeably larger with significant re-entrainment. |
| 22.9 | Liquid still drains vertically down the block faces, however; once it hits an angled mastic joint it tends to travel laterally until it encounters the sidewall of the wind tunnel. All of the bars are getting noticeably larger with significant re-entrainment. |
| 24.4 | The panel is entering the flooding regime where the liquid film thickness increases such that the liquid on the gas-liquid interface flows up and the liquid on the block surface flows downward. Some liquid drains vertically down the block faces and lateral liquid movement was observed at the angled mastic joints. Significant re-entrainment was observed at many locations. |

TABLE 4

| 20° Inclined parallelogram shaped blocks in sawtooth pattern | |
|---|---|
| Gas flow velocity (m/s) | Observations |
| 13.7 | Liquid flows freely down across both the block faces and the mastic membrane joints. |
| 15.2 | Liquid flows freely down across both the block faces and the mastic membrane joints. Lateral liquid movement was observed at some of the angled mastic joints. |
| 16.8 | Liquid flows freely down across the block faces. Small liquid bars form above the angled mastic joints. The bars then move laterally across the mastic joints until they encounter the next block and then the liquid film drains down that block face. |
| 18.3 | Liquid flows freely down across the block faces. Small liquid bars form above the angled mastic joints. The bars then move laterally across the mastic joints until they encounter the next block and then the liquid film drains down that block face. |
| 19.8 | Liquid flows freely down across the block faces. Small liquid bars form above the angled mastic joints. The bars then move laterally across the mastic joints until they encounter the next block and then the liquid film drains down that block face. |
| 21.3 | Liquid flows freely down across the block faces. Larger liquid bars form above the angled mastic joints. The bars then move laterally across the mastic joints until they encounter the next block and then the liquid film drains down that block face. Sporadic re-entrainment was observed. |
| 22.9 | Liquid flows down across the block faces, however; waves are forming on the surface of the liquid. Large liquid bars form above the angled mastic joints. The bars then move laterally across the mastic joints until they encounter the next block and then the liquid film drains down that block face. The lateral movement is less intense than was observed at the lower velocities. Re-entrainment was observed. |
| 24.4 | The panel is entering the flooding regime. Significant liquid upflow was observed on the block faces. Later liquid movement above the angled mastic joints was limited. Significant re-entrainment was observed at many locations. |

TABLE 5

| 45° Pattern of rectangular blocks | |
|---|---|
| Gas flow velocity (m/s) | Observations |
| 16.8 | Liquid drains freely across the surface of the blocks and also follows the angled mastic joints downwards. |
| 18.3 | Liquid drains freely across the surface of the blocks and also follows the angled mastic joints downwards. |
| 19.8 | Liquid drains freely across the surface of the blocks and also follows the angled mastic joints downwards. The liquid is beginning to preferentially flow along the angled mastic joints. |
| 21.3 | Liquid drains freely across the surface of the blocks and also follows the angled mastic joints downwards. The liquid is preferentially flowing along the angled mastic joints in both directions. |
| 22.9 | Waves are beginning to form in the liquid as it drains down the surface of the blocks. The velocity of the liquid flowing down the angled mastic joints is noticeably slower than was observed for the previous test cases. Sporadic re-entrainment was observed. |
| 24.4 | The panel is entering the flooding regime. Significant re-entrainment was observed at many locations, however; the majority of the liquid flow was downward. |
| 25.9 | The panel is in the flooding regime. Significant re-entrainment was observed at numerous locations. Minimal liquid flow downward. |

The invention claimed is:

1. An industrial chimney for wet stack operation provided with an internal lining system attached to the inner surface of the chimney, wherein the internal lining system comprises construction elements, that are arranged, separated by joints, in a pattern, wherein a plurality of the joints between the construction elements in the pattern at a flue gas side of the internal lining system are inclined at an angle α of at least 5 degrees from horizontal.

2. The industrial chimney according to claim 1, wherein the joints between the construction elements in the pattern at the flue gas side of the internal lining system are inclined at an angle α of at least 10 degrees from horizontal.

3. The industrial chimney according to claim 1, wherein the construction elements have a parallel front and back face that have a rectangular shape.

4. The industrial chimney according to claim 1, wherein the construction elements have a parallel front and back face that have a parallelogram shape.

5. The industrial chimney according to claim 4, wherein the construction elements are arranged in the pattern such that vertical joints between construction elements, that are adjacent to each other in the vertical direction of the chimney are inline with each other.

6. The industrial chimney according to claim 4, wherein the construction elements are arranged in the pattern such that vertical joints between construction elements, that are adjacent to each other in the vertical direction of the chimney are staggered.

7. The industrial chimney according to claim 1, wherein the construction elements are made of borosilicate glass.

8. The industrial chimney according to claim 1, wherein the construction elements are made of closed cell foamed borosilicate glass.

9. The industrial chimney according to claim 1, wherein the joints between the construction elements in the pattern at the flue gas side of the internal lining system are inclined at an angle $\alpha$ of 20 degrees or more.

10. The industrial chimney according to claim 1, wherein the joints between the construction elements in the pattern at the flue gas side of the internal lining system are inclined at an angle $\alpha$ of about 45 degrees.

11. A process for refurbishing an existing chimney with a fresh internal lining system for the purpose of increasing the critical re-entrainment velocity, wherein the internal lining system is manufactured from construction elements that are adhesively attached to the inner surface of the chimney, wherein the construction elements are arranged, separated by joints, in a pattern, such that a plurality of the joints between the construction elements in the pattern at a flue gas side of the internal lining system are inclined at an angle $\alpha$ of at least 5 degrees from horizontal.

* * * * *